US009719324B2

(12) United States Patent
Shaw

(10) Patent No.: US 9,719,324 B2
(45) Date of Patent: Aug. 1, 2017

(54) OPERATION OF MULTIPLE INTERCONNECTED HYDRAULIC ACTUATORS IN A SUBTERRANEAN WELL

(71) Applicant: HALLIBURTON ENERGY SERVICES, INC., Houston, TX (US)

(72) Inventor: Joel D. Shaw, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 256 days.

(21) Appl. No.: 13/753,981

(22) Filed: Jan. 30, 2013

(65) Prior Publication Data

US 2013/0213666 A1 Aug. 22, 2013

(30) Foreign Application Priority Data

Feb. 17, 2012 (WO) ..... PCT/US2012/025677

(51) Int. Cl.
*E21B 34/06* (2006.01)
*E21B 23/04* (2006.01)

(52) U.S. Cl.
CPC ..... *E21B 34/06* (2013.01); *E21B 23/04* (2013.01)

(58) Field of Classification Search
USPC ..... 166/373, 386, 319, 320, 321, 325
See application file for complete search history.

(56) References Cited

U.S. PATENT DOCUMENTS

| | | | | |
|---|---|---|---|---|
| 4,497,369 | A | 2/1985 | Hurta et al. | |
| 6,567,013 | B1 | 5/2003 | Purkins et al. | |
| 6,659,184 | B1 * | 12/2003 | Tips et al. | 166/375 |
| 7,240,737 | B2 | 7/2007 | Tips | |
| 7,520,332 | B2 | 4/2009 | Smithson | |
| 7,836,956 | B2 | 11/2010 | Smithson et al. | |
| 2001/0037884 | A1 | 11/2001 | Schultz et al. | |
| 2009/0065218 | A1 | 3/2009 | Loretz et al. | |

OTHER PUBLICATIONS

International Search Report with Written Opinion issued Feb. 14, 2013 for PCT Patent Application No. PCT/US12/025677, 11 pages.
Lee Company drawing No. LK0052J, dated Dec. 2009, 1 page.
Lee Company drawing No. LK0052N, dated Dec. 2010, 1 page.
(Continued)

*Primary Examiner* — Sean Andrish
(74) *Attorney, Agent, or Firm* — Locke Lord LLP

(57) ABSTRACT

A system for use with a well can include multiple hydraulic actuators in the well, each of the actuators being connected to a common hydraulic line, and multiple pressure control devices, each pressure control device preventing flow from the hydraulic line to a respective one of the actuators unless a pressure differential across the pressure control device exceeds a predetermined level. A method of controlling operation of multiple hydraulic actuators in a well can include applying pressure to at least one of the actuators, thereby increasing pressure in a common hydraulic line connected to each of the actuators, preventing communication of the increased pressure in the common hydraulic line to additional actuators, and permitting flow from the common hydraulic line to each of the actuators, in response to a pressure differential across the pressure control devices exceeding a predetermined level.

20 Claims, 4 Drawing Sheets

(56) References Cited

OTHER PUBLICATIONS

Society of Petroleum Engineers; "Comparison of Downhole Control Systems Technologies for Intelligent Completions", CSUG/SPE 147547, dated Nov. 15-17, 2011, 7 pages.
Halliburton; "Surface Positioning: Reservoir Optimization and Control", company presentation, received Dec. 20, 2011, 16 pages.
Halliburton; "Reservoir Optimization for Mature or Marginal Fields", product data sheet WD-13(s), dated Apr. 2011, 1 page.
Canadian Examiner's Report #2, dated Jun. 6, 2016, issued during the prosecution of Canadian Patent Application No. 2,860,778.

* cited by examiner

OPERATION OF MULTIPLE INTERCONNECTED HYDRAULIC ACTUATORS IN A SUBTERRANEAN WELL

CROSS-REFERENCE TO RELATED APPLICATION

This application claims the benefit under 35 USC §119 of the filing date of International Application Serial No. PCT/US12/25677 filed 17 Feb. 2012. The entire disclosure of this prior application is incorporated herein by this reference.

BACKGROUND

This disclosure relates generally to equipment utilized and operations performed in conjunction with a subterranean well and, in one example described below, more particularly provides for operation of multiple interconnected hydraulic actuators in a well.

Hydraulic actuators have qualities (such as, low cost, reliability, effectiveness, etc.) which make them useful for operating well tools. However, as the number of downhole hydraulic actuators increases, it can be difficult to individually control the actuators, while also limiting a number of hydraulic lines used to deliver pressure to the actuators.

Therefore, it will be appreciated that improvements are continually needed in the art of controlling operation of multiple hydraulic actuators in a well.

SUMMARY

In this disclosure, systems and methods are provided which bring improvements to the art of actuating well tools with hydraulic actuators. An example is described below in which some actuators are prevented from operating inadvertently when another actuator is operated.

The disclosure below provides to the art a system for use with a subterranean well. In one example, the system can include multiple hydraulic actuators in the well, each of the actuators being connected to a common hydraulic line, and multiple pressure control devices, each pressure control device preventing flow from the hydraulic line to a respective one of the actuators unless a pressure differential across the pressure control device exceeds a predetermined level.

Also described below is a method of controlling operation of multiple hydraulic actuators in a subterranean well. In one example, the method can include: applying pressure to at least one of the actuators, thereby increasing pressure in a common hydraulic line connected to each of the actuators; preventing communication of the increased pressure in the common hydraulic line to additional ones of the actuators; and permitting flow from the common hydraulic line to each of the actuators, in response to a pressure differential across respective multiple pressure control devices exceeding a predetermined level.

A well tool control system is also described below. In one example, the system can include multiple hydraulic actuators, each of the actuators being connected to a common hydraulic line, and multiple pressure control devices, each pressure control device including a relief valve which prevents displacement of a piston of a respective one of the actuators unless a pressure differential across the pressure control device exceeds a predetermined level.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
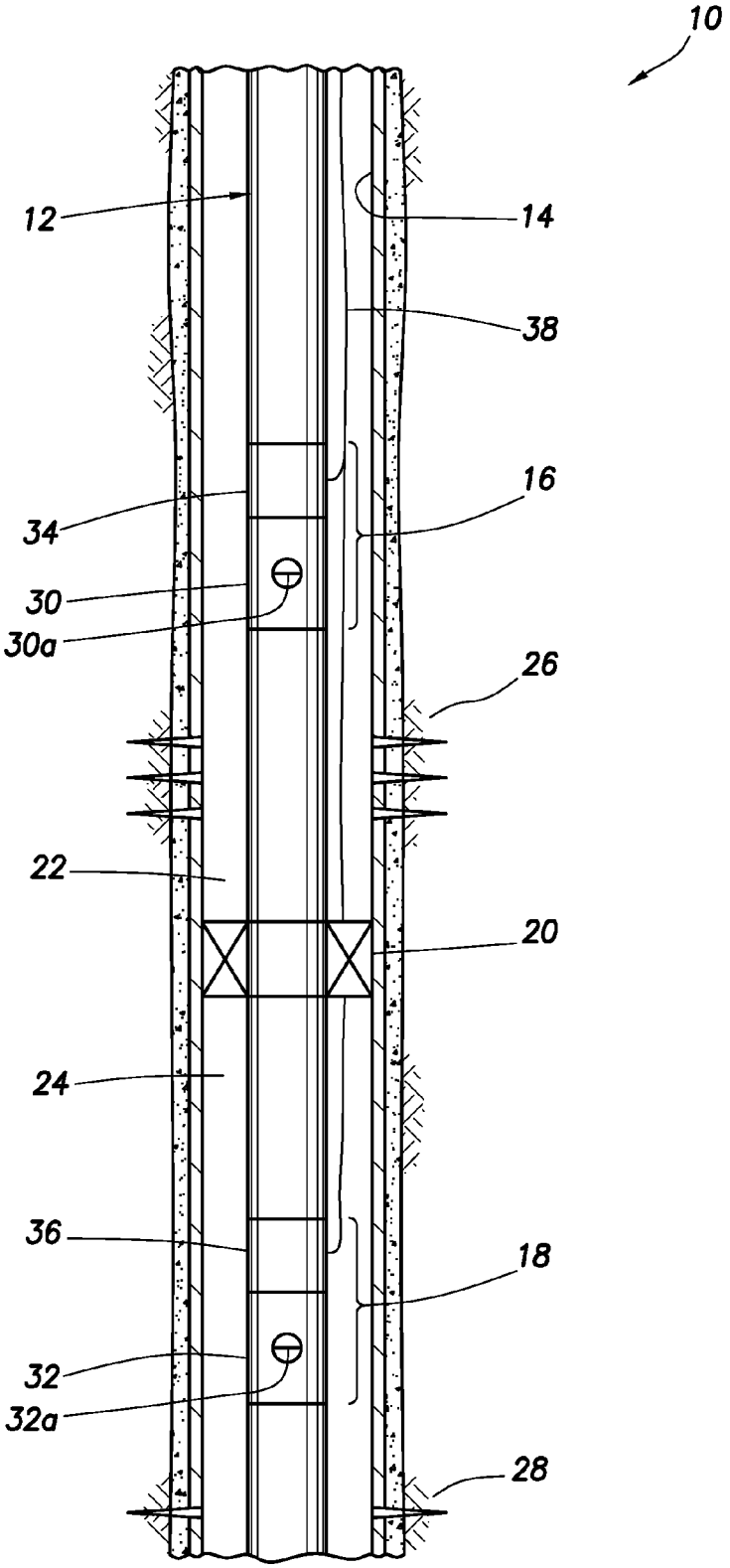
FIG. 1 is a representative partially cross-sectional view of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is positioned in a wellbore 14. Interconnected in the tubular string 12 are well tools 16, 18 and a packer 20 which isolates an upper annulus 22 from a lower annulus 24.

The upper annulus 22 is in communication with a formation interval or zone 26, and the lower annulus 24 is in communication with another interval or zone 28. The well tool 16 is used to control flow between the zone 26 and an interior of the tubular string 12 via the upper annulus 22, and the well tool 18 is used to control flow between the zone 28 and the interior of the tubular string via the lower annulus 24.

The well tools 16, 18 and the packer 20 are merely examples of well tools which can incorporate the principles of this disclosure. It should be clearly understood that actuation of well tools other than flow control tools and packers may be improved, without departing from the scope of this disclosure. Although only two well tools 16, 18 and the packer 20 are depicted in FIG. 1, actuation of any number of well tools can be controlled using the principles of this disclosure.

The well tools 16, 18 include respective flow control devices 30, 32. Each of the flow control devices 30, 32 is used to selectively permit or prevent flow between the interior of the tubular string 12 and the respective annuli 22, 24 (and, therefore, the respective zones 26, 28). Closure devices 30*a*, 32*a* of the respective flow control devices 30, 32 are used, in this example, to selectively block or choke flow between the tubular string 12 interior and the respective annuli 22, 24.

The flow control devices 30, 32 can be of the types known to those skilled in the art as production valves, downhole chokes, interval control valves, etc. The flow control devices 30, 32 can variably restrict flow, for example, by positioning the respective closure devices 30*a*, 32*a* between their fully open and fully closed positions.

The well tools 16, 18 also include respective actuators 34, 36 for operating the respective flow control devices 30, 32. The actuators 34, 36 are hydraulic actuators which actuate in response to pressure in hydraulic lines 38 extending to the actuators from a remote location (such as, the surface, a subsea facility, a floating platform, etc.), as described more fully below.

It is desirable to be able to individually actuate the actuators 34, 36 in order to individually operate the flow control devices 30, 32. For example, it may be desired to allow more flow through the flow control device 30 as compared to the flow control device 32 at times, and vice versa. Furthermore, the amount of flow to be permitted through each flow control device 30, 32 can change over time, and so the ability to separately operate the flow control devices is very beneficial.

Another desire is to reduce the number of hydraulic lines 38 installed. Installation of hydraulic lines can be expensive and time-consuming, and the lines can become damaged during installation or thereafter. Although the lines 38 are depicted in FIG. 1 as being external to the tubular string 12, they could in other examples be internal to the tubular string, or they could extend through a wall of the tubular string.

Although the tubular string 12 is depicted in FIG. 1 as being a production or injection string, in other examples the tubular string could be another type of string. For example, the tubular string 12 could be a casing string, liner string, completion string, testing string, or any other type of string.

Figure 2:
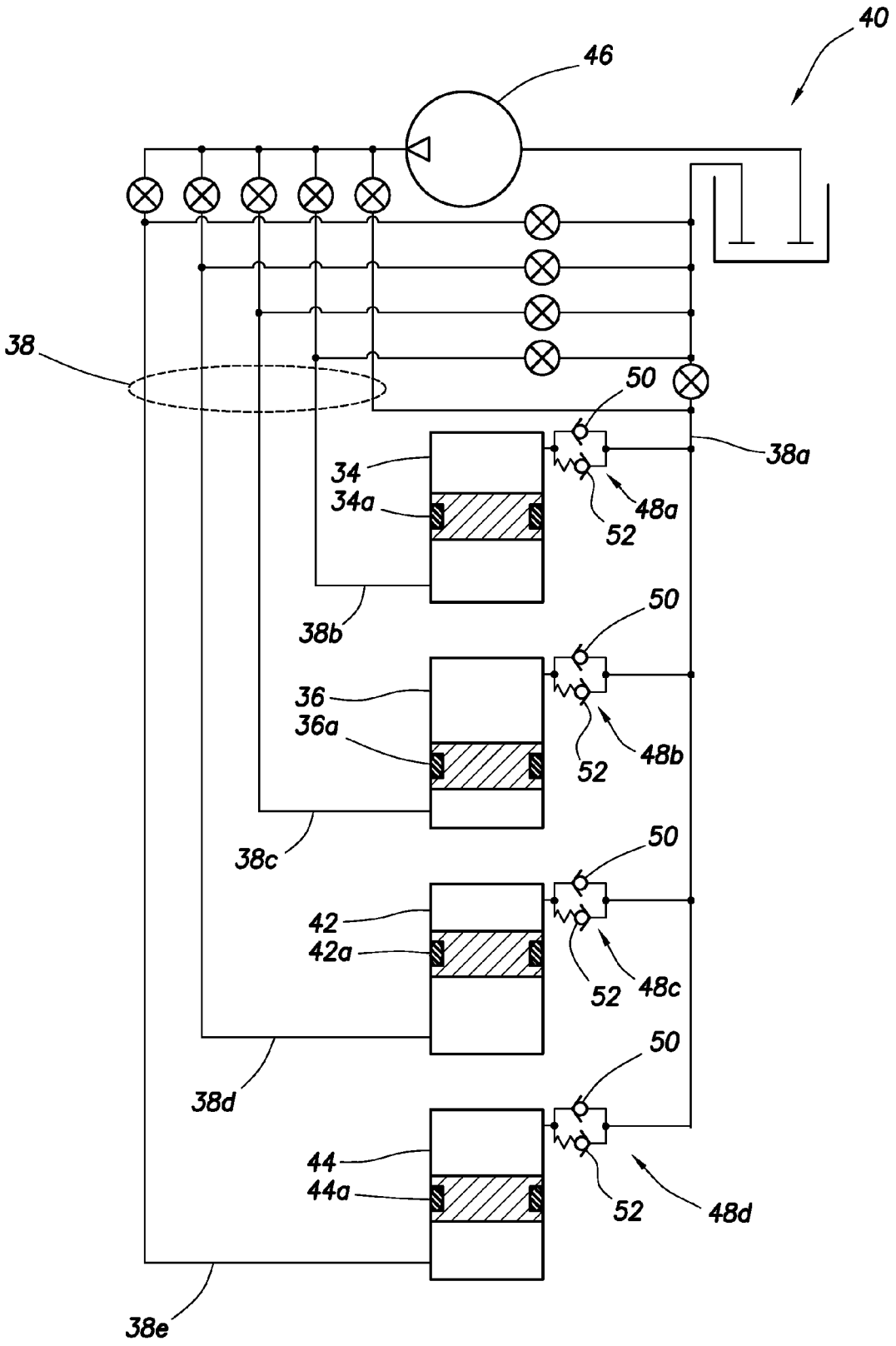
FIG. 2 is a representative schematic view of a well tool control system which may be used in the system and method of FIG. 1, and which can embody the principles of this disclosure.

Referring additionally now to FIG. 2, a system 40 for controlling operation of well tools is representatively illustrated in schematic form. The system 40 may be used in the well system 10 of FIG. 1 for controlling operation of the well tools 16, 18, or the system 40 may be used in other well systems and methods.

Four hydraulic actuators 34, 36, 42, 44 are depicted in the FIG. 2 example, two of which are used in the system 10 of FIG. 1 for actuating the well tools 16, 18. The additional two actuators 42, 44 may also be used for actuating flow control devices or any other type of well tools. Any number of actuators may be used in keeping with the scope of this disclosure.

Two hydraulic lines could be connected to each actuator 34, 36, 42, 44 in order to displace respective pistons 34*a*, 36*a*, 42*a*, 44*a* in each of two respective opposite directions. However, to reduce the number of lines 38 extending in the wellbore 14, a common line 38*a* is connected to each of the actuators 34, 36, 42, 44.

In the FIG. 2 example, pressure can be applied to the common line 38*a* (e.g., using a pump 46 or another pressure source positioned at a remote location) to thereby displace all of the pistons 34*a*, 36*a*, 42*a*, 44*a* downward (as viewed in FIG. 2). This capability can be used to "reset" all of the actuators 34, 36, 42, 44 to a known position.

For example, in the system 10 of FIG. 1, pressure could be applied to the common line 38*a* to close all of the flow control devices 30, 32. The pistons 34*a*, 36*a* in this example could be connected to the respective closure devices 30*a*, 32*a* of the flow control devices 30, 32. Similar closure devices could be connected to the other pistons 42*a*, 44*a*.

Pressure can be applied to one of the other lines 38*b-e* to displace a respective one of the pistons 34*a*, 36*a*, 42*a*, 44*a* upward. A certain volume of hydraulic fluid can be discharged from one of the lines 38*b-e* into the respective one of the actuators 34, 36, 42, 44 to produce a corresponding amount of displacement of the respective one of the pistons 34*a*, 36*a*, 42*a*, 44*a*. This capability can be used to set each individual flow control device at a respective desired position to permit a corresponding amount of production or injection flow.

Note that, when fluid is discharged from one of the lines 38*b-e* into its respective one of the actuators 34, 36, 42, 44, a corresponding amount of fluid is discharged from the actuator to the common line 38*a*. In many practical applications, however, the common line 38*a* will have a fairly small flow area and will extend thousands of meters (perhaps a mile or more) from the remote location to the actuators 34, 36, 42, 44.

As a result, pressure in the common line 38*a* can increase when pressure is applied to one of the actuators 34, 36, 42, 44 via a respective one of the lines 38*b-e*. To prevent this pressure increase in the common line 38*a* from affecting the positions of the other pistons (the pistons not corresponding to the one of the lines 38*b-e* to which pressure was applied), the system 40 includes pressure control devices 48*a-d* interconnected between the common line and the respective actuators 34, 36, 42, 44.

In the FIG. 2 example, each of the pressure control devices 48*a-d* includes a check valve 50 and a relief valve 52. The check valve 50 and relief valve 52 are preferably connected in parallel, as depicted in FIG. 2.

The check valve 50 permits relatively unrestricted flow from an actuator to the common line 38*a*. Thus, when pressure is applied to one of the lines 38*b-d*, the respective one of the pistons 34*a*, 36*a*, 42*a*, 44*a* can displace as desired, and fluid will be readily discharged from the respective one of the actuators 34, 36, 42, 44 to the common line 38*a*.

However, a pressure increase in the common line 38*a* will not be communicated to any of the actuators 34, 36, 42, 44 unless a pressure differential across the respective relief valve 52 is greater than a predetermined level. For example, the relief valves 52 could be set to open at a pressure differential of 10.3 MPa (~1500 psi), so that an inadvertent increase in pressure in the common line 38*a* will not cause unintended displacement of any of the pistons 34*a*, 36*a*, 42*a*, 44*a*.

Pressure can be applied to the common line 38*a* when desired to displace all of the pistons 34*a*, 36*a*, 42*a*, 44*a* (for example, to "reset" all of the actuators 34, 36, 42, 44), and that pressure will be communicated to all of the actuators when the pressure differential across the relief valves 52 exceeds the predetermined level. Note that it is not necessary for all of the relief valves 52 to open at the same time, or for all of the relief valves to have the same opening differential pressure.

It is contemplated that the predetermined pressure differential level in most practical applications will be about 6.9-17.2 MPa (~1000-2500 psi), but other levels may be used as desired. In general, it is expected that the level should increase with increasing depth, but this is not necessary and a number of factors (e.g., length of the line 38*a*, flow area in the line, temperature, type of hydraulic fluid, etc.) can influence the value of the predetermined pressure differential level.

Although in FIG. 2 the pressure control devices 48*a-d* are depicted as including separate check valves 50 and relief valves 52, in other examples more or less components may be included in the pressure control devices, and the check valves and relief valves could be combined. A suitable combined check and relief valve is marketed by Lee Co. of Westbrook, Conn. USA (e.g., a Lee P.R.I./Chek Combination Valve).

Figure 3:
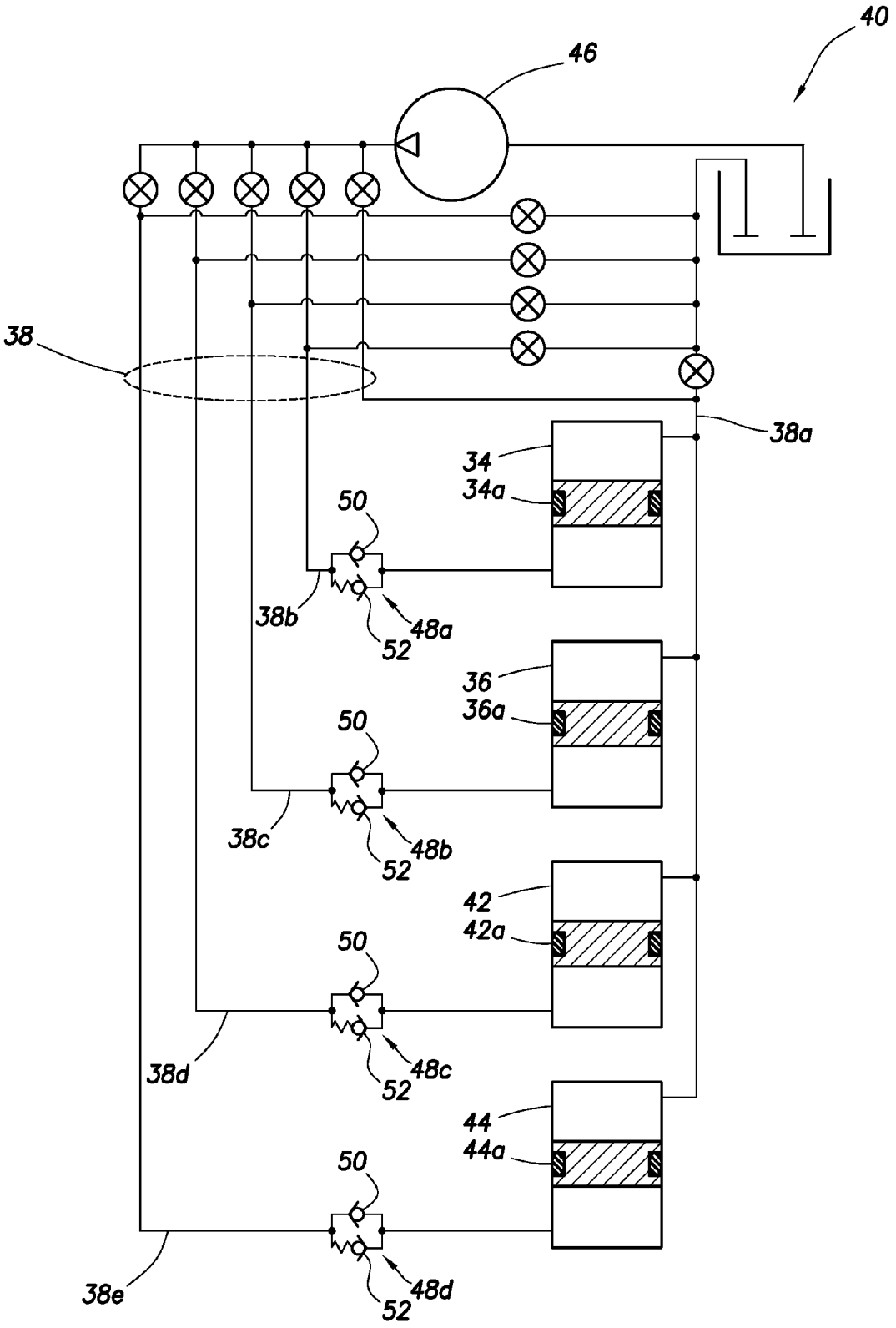
FIGS. 3 & 4 are representative schematic views of additional examples of the well tool control system.

Referring additionally now to FIG. 3, another example of the control system 40 is representatively illustrated. In this example, the pressure control devices 48*a-d* are connected between the actuators 34, 36, 42, 44 and the respective lines 38*b-e*.

It will be appreciated by those skilled in the art that the system 40 configuration of FIG. 3 will operate essentially the same as the configuration of FIG. 2. One difference is that, when applying pressure to the actuators 34, 36, 42, 44 from the common line 38*a*, the increased pressure will be transmitted by the pistons 34*a*, 36*a*, 42*a*, 44*a* to the pressure control devices 48*a-d*.

In another example, the pressure control devices 48*a-d* could be connected both: a) between the common line 38*a* and the respective actuators 34, 36, 42, 44 (as in the FIG. 2 example), and b) between the actuators and the respective lines 38*b-e* (as in the example of FIG. 3). Thus, various combinations and arrangements of components may be used, in keeping with the scope of this disclosure.

Figure 4:
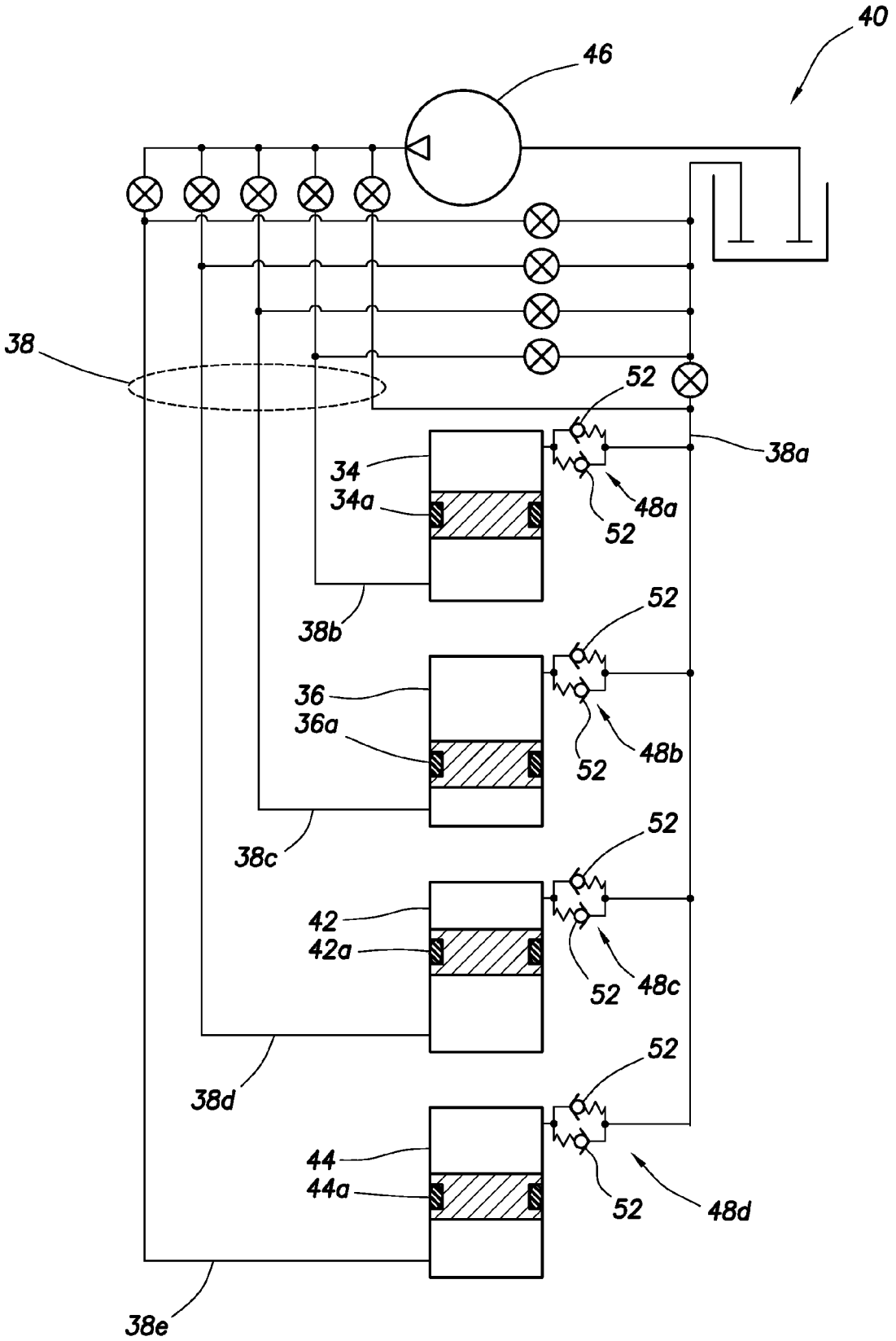

Referring additionally now to FIG. 4, another example of the control system 40 is representatively illustrated. In this example, the check valves 50 are replaced by relief valves 52 in the pressure control devices 48*a-d*.

To displace any of the pistons 34*a*, 36*a*, 42*a*, 44*a* upward (as viewed in FIG. 4), sufficient pressure must be applied to the respective line 38*b-e* to open the upper relief valve in the respective pressure control device 48*a-d*. For example, a pressure differential from the respective line 38*b-e* to the common line 38*a* must exceed an opening pressure of the upper relief valve 52 in the respective pressure control device 48*a-d*.

Note that this arrangement (oppositely directed relief valves 52 connected in parallel) may be used in the FIGS. 2 & 3 examples, as well. The pressure control devices 48*a-d* of FIG. 4 may be connected on either side of the actuators 34, 36, 42, 44. It is not necessary for the relief valves 52 in a pressure control device to open at the same differential pressure level.

It can now be fully appreciated that the above disclosure provides significant advancements to the art of controlling operation of multiple hydraulic actuators in a well. In the system 40, the number of hydraulic lines 38 is reduced by using a common line 38*a* connected to each of the actuators 34, 36, 42, 44, and inadvertent actuation of the actuators is avoided by interconnecting the pressure control devices 48*a-d* between the common line and the respective actuators.

A system 10 for use with a subterranean well is described above. In one example, the system 10 comprises multiple hydraulic actuators 34, 36, 42, 44 in the well, each of the actuators 34, 36, 42, 44 being connected to a common hydraulic line 38*a*, and multiple pressure control devices 48*a-d*, each pressure control device 48*a-d* preventing flow from the hydraulic line 38*a* to a respective one of the actuators 34, 36, 42, 44 unless a pressure differential across the pressure control device 48*a-d* exceeds a predetermined level.

Each pressure control device 48*a-d* may permit flow from the hydraulic line 38*a* to the respective one of the actuators 34, 36, 42, 44 in response to the pressure differential being greater than the predetermined level.

The pressure control devices 48*a-d* can permit flow from the actuators 34, 36, 42, 44 to the hydraulic line 38*a*.

Each pressure control device 48*a-d* may include a relief valve 52 which opens at the predetermined pressure differential level.

Each pressure control device 48*a-d* may include a check valve 50 which prevents flow through the check valve 50 from the hydraulic line 38*a* to the respective one of the actuators 34, 36, 42, 44. A relief valve 52 can be connected in parallel with the check valve 50.

The system 10 can also include multiple flow control devices 30, 32 which selectively control flow between an interior and an exterior of a tubular string 12. Each of the actuators 34, 36 can actuate a respective one of the flow control devices 30, 32.

Also described above is a method of controlling operation of multiple hydraulic actuators 34, 36, 42, 44 in a subterranean well. In one example, the method comprises: applying pressure to at least one of the actuators 34, 36, 42, 44, thereby increasing pressure in a common hydraulic line 38*a* connected to each of the actuators 34, 36, 42, 44; preventing communication of the increased pressure in the common hydraulic line 38*a* to additional ones of the actuators 34, 36, 42, 44; and permitting communication between the common hydraulic line 38*a* and each of the actuators 34, 36, 42, 44, in response to a pressure differential across multiple respective pressure control devices 48*a-d* exceeding a predetermined level.

The method can also include connecting the pressure control devices 48*a-d* between the common hydraulic line 38*a* and the actuators 34, 36, 42, 44, each pressure control device 48*a-d* preventing displacement of a piston 34*a*, 36*a*, 42*a*, 44*a* of a respective one of the actuators 34, 36, 42, 44 unless the pressure differential from the hydraulic line 38*a* to the respective one of the actuators 34, 36, 42, 44 exceeds the predetermined level.

A well tool control system 10 is also described above. In one example, the control system 10 comprises multiple hydraulic actuators 34, 36, 42, 44, each of the actuators 34, 36, 42, 44 being connected to a common hydraulic line 38*a*, and multiple pressure control devices 48*a-d*, each pressure control device 48*a-d* including a relief valve 52 which prevents displacement of a piston 34*a*, 36*a*, 42*a*, 44*a* of a respective one of the actuators 34, 36, 42, 44 unless a pressure differential across the pressure control device exceeds a predetermined level.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A system for use with a subterranean well, the system comprising:

a plurality of hydraulic actuators in the well, all of the actuators being hydraulically connected to a common hydraulic line, and each of the actuators being hydraulically connected to a different one of a plurality of dedicated hydraulic lines, wherein each dedicated hydraulic line only operates a respective one of the actuators to which the dedicated hydraulic line is hydraulically connected, wherein each of the plurality of actuators is only hydraulically connected to the common hydraulic line and one of the plurality of dedicated hydraulic lines such that each actuator is only connected to two hydraulic lines, wherein a common line shutoff valve is operatively connected between the common line and a pump, wherein a dedicated line shutoff valve is operatively connected to each dedicated hydraulic line between each of the actuators and the pump; and a plurality of pressure control devices, each pressure control device preventing flow from the common hydraulic line to a respective one of the actuators unless a pressure differential across the respective pressure control device exceeds a predetermined level, whereby all of the hydraulic actuators can all be reset to a known position by applying pressure to the common hydraulic line, wherein pressure will be communicated to all of the actuators when the pressure differential across the pressure control devices exceeds the predetermined level.

2. The system of claim 1, wherein each pressure control device permits flow from the common hydraulic line to the respective one of the actuators in response to the pressure differential being greater than the predetermined level.

3. The system of claim 1, wherein the pressure control devices permit flow from the actuators to the common hydraulic line.

4. The system of claim 1, wherein each pressure control device includes a relief valve which opens at the predetermined pressure differential level.

5. The system of claim 1, wherein each pressure control device includes a check valve which prevents flow through the check valve from the common hydraulic line to the respective one of the actuators.

6. The system of claim 5, wherein each pressure control device includes a relief valve connected in parallel with the check valve.

7. The system of claim 1, further comprising multiple flow control devices which selectively control flow between an interior and an exterior of a tubular string, and wherein each of the actuators actuates a respective one of the flow control devices.

8. A method of controlling operation of multiple hydraulic actuators in a subterranean well, the method comprising:

hydraulically connecting each of the hydraulic actuators to only a common hydraulic line and a dedicated hydraulic line such that each actuator is only connected to two hydraulic lines;

applying pressure to one of the actuators via the dedicated hydraulic line which only operates the one of the actuators to which the dedicated hydraulic line is hydraulically connected, thereby increasing pressure in the common hydraulic line which is hydraulically connected to all of the actuators;

preventing communication of the increased pressure in the common hydraulic line to additional ones of the actuators; and permitting flow from the common hydraulic line to all of the actuators, in response to a pressure differential across all of the respective pressure control devices exceeding a predetermined level, thereby resetting all of the actuators to a known position, wherein a dedicated line shutoff valve is operatively connected to each dedicated hydraulic line between a pump and an actuator of the multiple hydraulic actuators, wherein a common line shutoff valve is operatively connected between the common line and the pump, and wherein permitting flow from the common hydraulic line to all of the actuators includes opening the common line shutoff valve and closing all of the dedicated line shutoff valves.

9. The method of claim 8, further comprising connecting the multiple pressure control devices between the common hydraulic line and the actuators, each pressure control device preventing flow from the common hydraulic line to a respective one of the actuators unless the pressure differential from the common hydraulic line to the respective one of the actuators exceeds the predetermined level.

10. The method of claim 8, wherein each pressure control device permits displacement of a piston of each of the actuators in response to the pressure differential being greater than the predetermined level.

11. The method of claim 8, wherein the pressure control devices permit flow from the actuators to the common hydraulic line.

12. The method of claim 8, wherein each pressure control device includes a relief valve which opens at the predetermined pressure differential level.

13. The method of claim 8, wherein each pressure control device includes a check valve which prevents flow from the common hydraulic line to the respective one of the actuators.

14. The method of claim 13, wherein each pressure control device includes a relief valve connected in parallel with the respective check valve.

15. The method of claim 8, wherein multiple flow control devices selectively control flow between an interior and an exterior of a tubular string, and wherein each of the actuators actuates a respective one of the flow control devices.

16. A well tool control system, comprising:

a plurality of hydraulic actuators, all of the actuators being hydraulically connected to a common hydraulic line, and each of the actuators being hydraulically connected to a dedicated different one of a plurality of dedicated hydraulic lines, wherein each dedicated hydraulic line only operates a respective one of the actuators to which the dedicated hydraulic line is hydraulically connected, wherein each of the plurality of actuators is only hydraulically connected to the common hydraulic line and one of the plurality of dedicated hydraulic lines such that each actuator is only connected to two hydraulic lines, wherein a common line shutoff valve is operatively connected between the common line and a pump, and wherein a dedicated line shutoff valve is operatively connected to each dedicated hydraulic line between each of the actuators and the pump; and a plurality of pressure control devices, each pressure control device including a relief valve which prevents displacement of a piston of each of the actuators unless a pressure differential across the pressure control device exceeds a predetermined level, whereby all of the hydraulic actuators can all be reset to a known position by applying pressure to the common hydraulic line, wherein pressure will be communicated to all of the actuators when the pressure differential across the pressure control devices exceeds the predetermined level.

17. The system of claim 16, wherein the pressure control devices permit flow from the actuators to the common hydraulic line.

18. The system of claim 16, wherein each pressure control device includes a check valve which prevents flow from the common hydraulic line to the respective one of the actuators.

19. The system of claim 18, wherein the relief valve is connected in parallel with the check valve in each of the pressure control devices.

20. The system of claim 16, further comprising multiple flow control devices which selectively control flow between an interior and an exterior of a tubular string, and wherein each of the actuators actuates a respective one of the flow control devices.

* * * * *